US005246392A

United States Patent [19]

Johnston

[11] Patent Number: 5,246,392

[45] Date of Patent: Sep. 21, 1993

[54] STERN DRIVE SYSTEM WITH ANTI-ROTATION BRACE

[75] Inventor: Daniel D. Johnston, Port Townsend, Wash.

[73] Assignee: Falcon Maritime Ventures, Inc., Colorado Springs, Colo.

[21] Appl. No.: 981,799

[22] Filed: Nov. 25, 1992

[51] Int. Cl.[5] ..... B63H 5/12

[52] U.S. Cl. ..... 440/42; 440/57; 440/61

[58] Field of Search ..... 114/144 R; 440/38, 40, 440/42, 49, 53, 57, 61, 63

[56] References Cited

U.S. PATENT DOCUMENTS 3,253,569 5/1966 Serdar ..... 440/59
4,645,463 2/1987 Arneson ..... 440/57
4,775,342 10/1988 Conner et al. ..... 440/57
4,846,741 7/1989 Betsinger ..... 440/57
4,981,452 1/1991 Grinde ..... 440/57

*Primary Examiner*—Jesus D. Sotelo
*Assistant Examiner*—Stephen P. Avila
*Attorney, Agent, or Firm*—Willian Brinks Olds Hofer Gilson & Lione

[57] ABSTRACT

A stern drive system includes a jet nozzle that is pivoted with respect to a mounting bracket and is steered by two hydraulic cylinders. An anti-rotation brace includes a rod pivotably mounted to the bracket and a sleeve pivotably mounted to the jet nozzle. The rod, the sleeve and the pivot mounts are constructed such that the antirotation brace prevents the jet nozzle from rotating about the longitudinal axis of the stern drive system, thereby allowing a modular, compact stern drive which provides advantages in terms of reduced manufacturing cost, reduced maintenance cost, and increased ease of installation.

15 Claims, 2 Drawing Sheets

STERN DRIVE SYSTEM WITH ANTI-ROTATION BRACE

BACKGROUND OF THE INVENTION

This invention relates to stern drive systems for boats and ships, and in particular to an improved stern drive system that is easier to install and less expensive to manufacture and maintain.

Stern drive systems commonly in use include a first propulsion element that is supported outside of a hull of a boat or ship, a second propulsion element, and a pivot joint that interconnects the first and second propulsion elements. If the stern drive is a jet drive, the second propulsion element will typically be a jet nozzle. If the stern drive is a propeller drive the second propulsion element will include a propeller. Typically, multiple actuators are coupled to the second propulsion element to steer the second propulsion element in two planes: a horizontal steering plane, which is used to steer left and right, and a vertical trim plane, which is used to change the vertical direction of thrust and thereby to trim the boat.

One widely used stern drive is sold under the trade name ARNESEN. This drive uses triangulated hydraulic cylinders to prevent the second propulsion element from rotating about an axis defined by the first propulsion element. With this approach opposed hydraulic cylinders maintain the second propulsion element pointed in the desired direction.

This approach brings with it several disadvantages. First, because the hydraulic cylinders work in opposition to one another, if they are not properly balanced the cylinders are subjected to increased wear, which results in reduced life and consequently increased maintenance cost. Second, this stern drive can be difficult to install. Installation is relatively expensive, and it often requires especially trained technicians to obtain the desired alignment. Furthermore, the installation is physically large, which may limit the application in some cases.

SUMMARY OF THE INVENTION

According to this invention, an anti-rotation brace is provided for a stern drive system of the type comprising first and second propulsion elements, a bracket configured to support the first propulsion element outside a hull of a water vessel, a pivot joint interconnecting the first and second propulsion elements, and at least one actuator coupled to the second propulsion element to steer the second propulsion element.

The anti-rotation brace of this invention comprises first and second portions. The first portion is secured in place relative to the first propulsion element to resist rotation about a first axis defined by the first propulsion element. The second portion is secured to the second propulsion element to resist rotation of the second propulsion element about the first axis. The first and second portions are slidably interconnected to telescope together, and they are effective to brace the second propulsion element against rotation relative to the first propulsion element about the first axis, while accommodating steering of the second propulsion element by the actuator.

As pointed out below, the preferred embodiments shown in the drawings positively prevent the second propulsion element from rotating. In addition, the brace can be configured to provide an automatic trim function in response to the steering movement of the second propulsion element. For example, the anti-rotation brace described below is designed to point the jet nozzle downwardly when the nozzle is pivoted either to the left or to the right. In many designs such automatic trim adjustment is advantageous.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
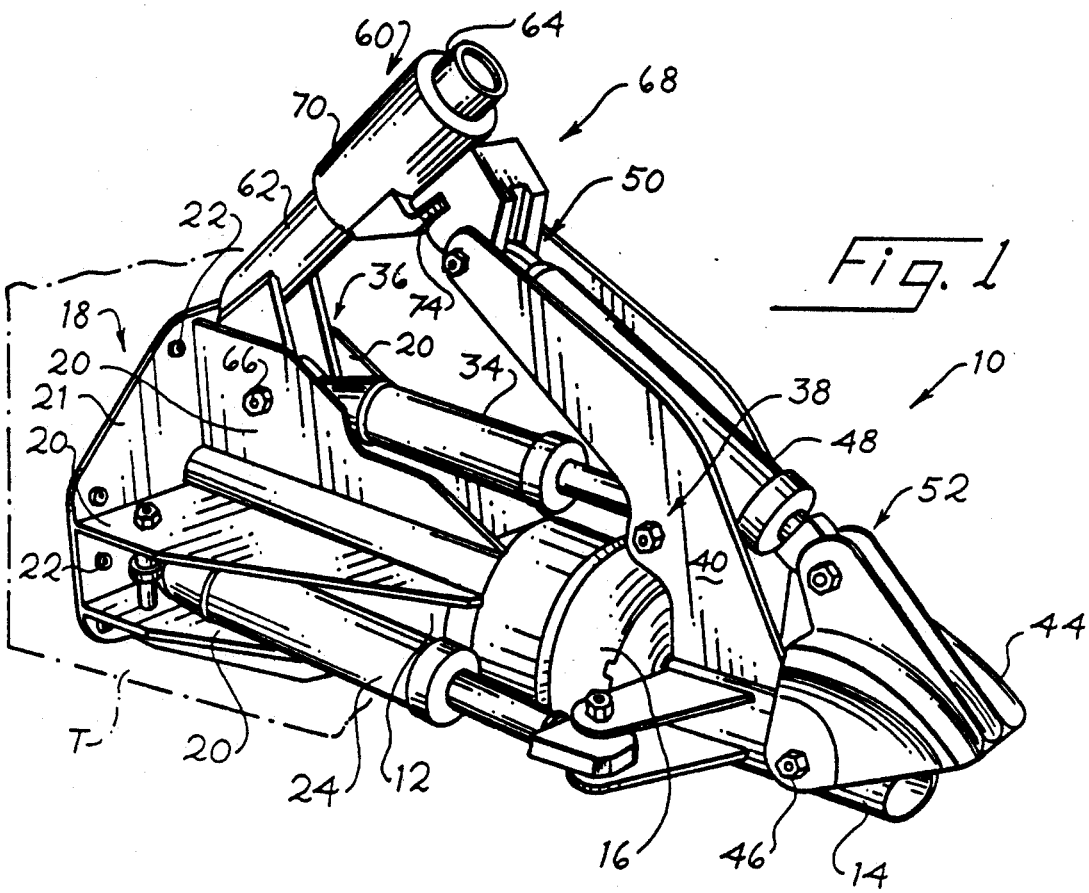
FIG. 1 is a perspective view of a stern drive system which incorporates a presently preferred embodiment of this invention.

Turning now to the drawings, FIG. 1 shows a perspective view of a stern drive system 10 mounted on the transom T of a surface water vessel such as a boat or a ship. While only one is shown in the drawings, typically two or more stern drive systems are mounted side by side on the transom T of the boat. The stern drive system 10 includes first and second propulsion elements 12, 14 interconnected by pivot joint 16. In this embodiment the first and second propulsion elements 12, 14 are conduits, and the second propulsion element 14 forms a jet nozzle suitable for a jet drive. In this embodiment the pivot joint 16 can be implemented simply as a ball joint.

Figure 6:
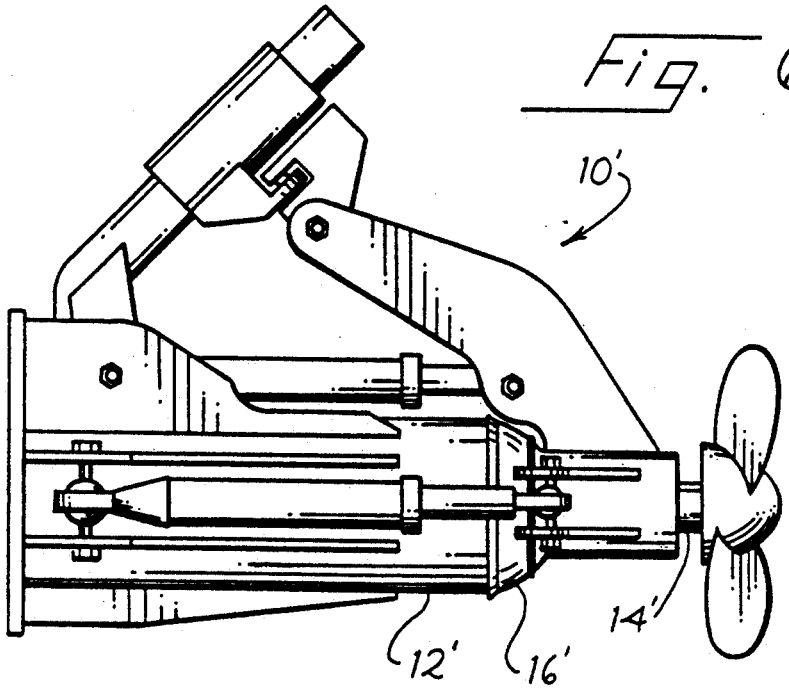
FIG. 6 is a side elevational view of a second preferred embodiment of this invention adapted for use with a propeller drive.

In an alternate embodiment 10' shown in FIG. 6, the second propulsion element 14' comprises a propeller, and in this case the first propulsion element 12' can comprise a drive shaft, and the pivot joint 16' can comprise a universal joint or a constant velocity joint for example.

Returning to FIG. 1, the first propulsion element 12 is rigidly secured in place on the transom T by a bracket 18 which comprises an array of stiffeners 20 and a plate 21. For example, the stiffeners 20 can be welded (1) along the length of the first propulsion element 12 and (2) to the plate 21 that extends parallel to the transom T. This plate 21 can be readily mounted in place on the transom T by mounting bolts 22.

The second propulsion element 14 is pointed by a steering arrangement which includes a steering cylinder 24 and a trim cylinder 34. The steering cylinder 24 steers the second propulsion element 14 in a horizontal plane (so as to steer the boat to the left or to the right), while the trim cylinder 34 steers the second propulsion element 14 in a vertical plane (so as to adjust the trim of the boat).

Figure 5:
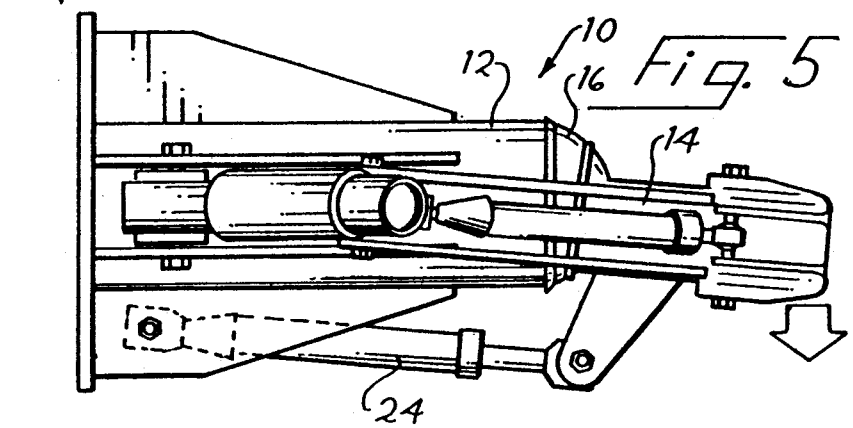
FIG. 5 is a top view corresponding to FIG. 3 showing the stern drive system of FIG. 1 with the jet nozzle steered to the port side.
Figure 2:
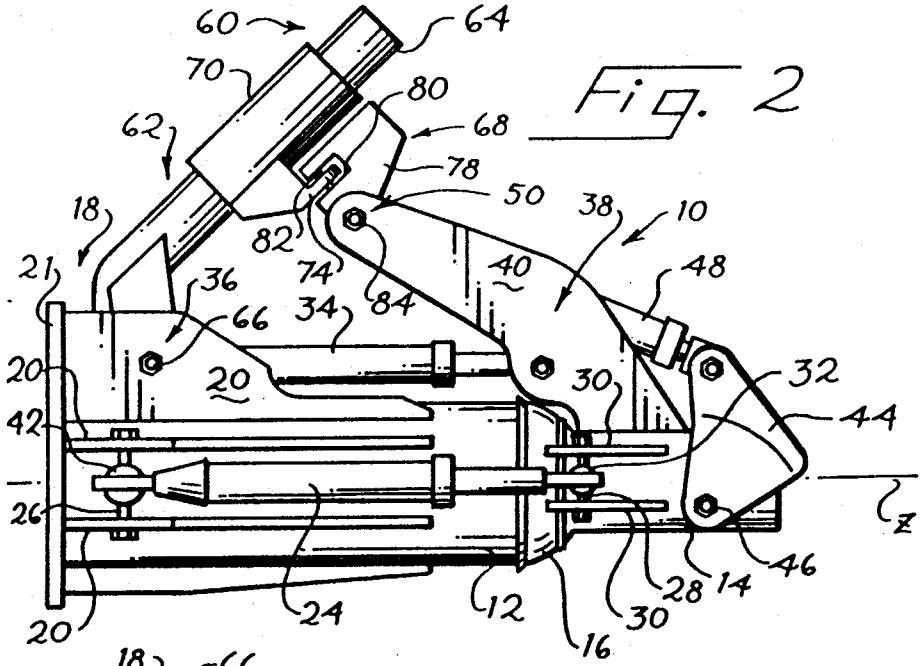
FIG. 2 is a side elevational view of the stern drive system of FIG. 1.

As best shown in FIG. 2, the steering cylinder 24 is secured between a forward cylinder mount 26 and an aft cylinder mount 28. The forward cylinder mount 28 includes a ball joint 32 secured between two adjacent ones of the stiffeners 20. The aft cylinder mount 28 also includes a ball joint 32 secured between two parallel flanges 30 that in this embodiment are welded directly to the second propulsion element 14. Extension and retraction of the steering cylinder 24 pivots the second propulsion element 14 with respect to the first propulsion element 12 about the pivot joint 16 in the horizontal plane, as shown in FIGS. 3 and 5.

As shown in FIGS. 1 and 2, the trim cylinder 34 is similarly mounted between a forward cylinder mount 36 and an aft cylinder mount 38. In this embodiment the forward cylinder mount 36 includes a ball joint (not shown) which is secured between two adjacent ones of the stiffeners 20, and the aft cylinder mount 38 includes a ball joint (not shown) which is secured between two parallel flanges 40 which in this embodiment are welded directly to the second propulsion element 14.

It should be noted that in this embodiment only a single steering cylinder 24 and only a single trim cylinder 34 are provided, and because of the ball joints the cylinders 24, 34 are largely isolated from transverse forces. The use of only two cylinders reduces the cost and facilitates installation of the stern drive system 10, and the use of the ball joints reduces transverse forces on the cylinders 24, 34 and thereby increases their service life.

Figure 3:
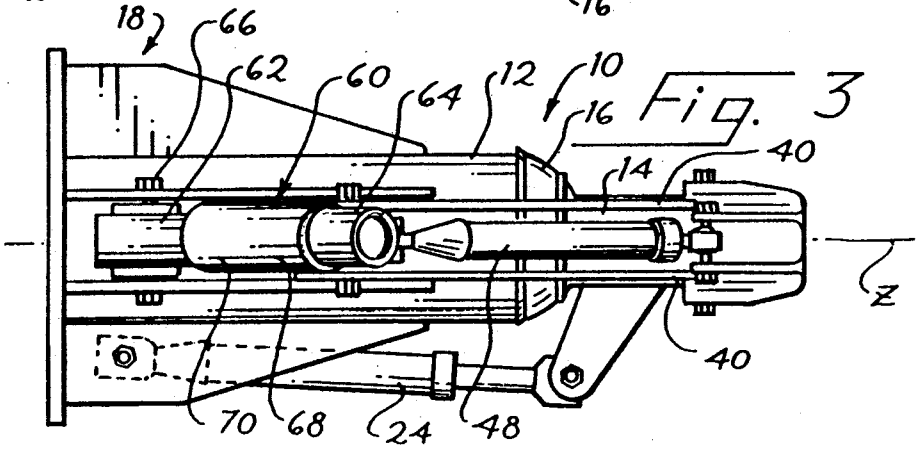
FIG. 3 is a top plan view of the stern drive system of FIG. 1.

One potential disadvantage of this arrangement is that the cylinders 24, 34 do not restrain the second propulsion element 14 from rotation about the Z axis which extends longitudinally through the center of the first propulsion element 12 (FIGS. 2 and 3). However, undesired rotation of the second propulsion element 14 about the Z axis is prevented by the antirotation brace 60 described below.

The stern drive system 10 also includes a reversing scoop 44 which is mounted to the second propulsion element 14 to pivot about an axis 46. The position of the reversing scoop 44 about the axis 46 is controlled by a reversing cylinder 48. The reversing cylinder 48 is mounted between a forward cylinder mount 50 and an aft cylinder mount 52. In this embodiment the forward cylinder mount 50 is positioned between the forwardmost portion of the flanges 40, and aft cylinder mount 52 is positioned between two parallel flanges on the reversing scoop 44. When the reversing cylinder 46 is retracted, the reversing scoop 44 is positioned as shown in FIG. 1, allowing forward propulsion. When reverse propulsion is desired, the reversing cylinder 48 is extended, thereby lowering the reversing scoop 44 and redirecting jet flow out of the second propulsion element 14 forwardly.

As best shown in FIGS. 1-3, the stern drive system 10 includes an anti-rotation brace 60 which is secured between the bracket 18 and the second propulsion element 14. This anti-rotation brace 60 includes a first portion 62 and a second portion 68.

The first portion 62 includes a rod 64 which is mounted to the bracket 18 between two adjacent ones of the stiffeners 20 to pivot about a pivot axis 66. This pivot axis 66 in this embodiment is positioned horizontally, transverse to a vertical plane passing through the Z axis. This arrangement allows the rod 64 to pivot up and down in a vertical plane passing through the axis Z, while substantially preventing movement of the rod 64 out of this plane.

The second portion 68 includes a sleeve 70 which is mounted to telescope freely on the rod 64. A key (not shown) is provided to prevent rotation of the sleeve 70 about the rod 64. The sleeve 70 defines a finger 74 which in turn defines an opening positioned transversely to the rod 64 in the vertical plane passing through the Z axis (FIG. 2).

The second portion 68 also includes a pivot joint 78 which defines two degrees of freedom (FIG. 2). The pivot joint 78 defines a slot 80 sized to receive the finger 74, and a shaft 82 which passes through the opening in the finger 74. The pivot joint 78 also defines a pivot axis 84 where it is mounted between the forward ends of the flanges 80. As shown in FIG. 2, the pivot axis 84 can coincide with the axis at the forward cylinder mount 50. Thus, the pivot joint 78 defines two rotational degrees of freedom.

Though not shown, hydraulic lines for the cylinders 24, 34, 48 preferably pass through the plate 21 of the bracket 18 and through the transom T. This arrangement provides a modular assembly in which all of the components on the stern drive system 10 are mounted on the bracket 18. With this arrangement the stern drive system 10 can readily be mounted in place on the transom T. This can be done by using a template to form openings in the transom T at the locations of the mounting bolts 22, and then securing the bracket 18 in place on the transom T and interconnecting the various hydraulic lines and the propulsion system. In this way, no complex field alignment is required, and substantially all alignment is provided by the elements of the stern drive system 10 itself. This results in a compact, inexpensive installation which does not require that personnel specially trained in alignment requirements of stern drive systems be used. The anti-rotation brace 60 prevents the second propulsion element 14 from rotating about the Z axis, while accommodating steering of the second propulsion element 14 in both the horizontal and the vertical planes.

If desired, the antirotation brace 60 can be configured such that the antirotation brace 60 automatically provides a desired trim correction when the second propulsion element 14 is steered in the horizontal plane by the steering cylinder 24. In the example shown in the drawings, the pivot axis 84 is positioned forwardly of the center of the pivot joint 16. With this arrangement, the second propulsion element 14 is automatically pointing downwardly when the second propulsion element 14 is steered either to the left or to the right with the steering cylinder 24. The reverse can be obtained by positioning the pivot axis 84 to the aft of the center of the pivot joint 16. In this way the antirotation brace 60 can be used to provide automatic trim correction in an inexpensive and reliable manner.

Figure 4:
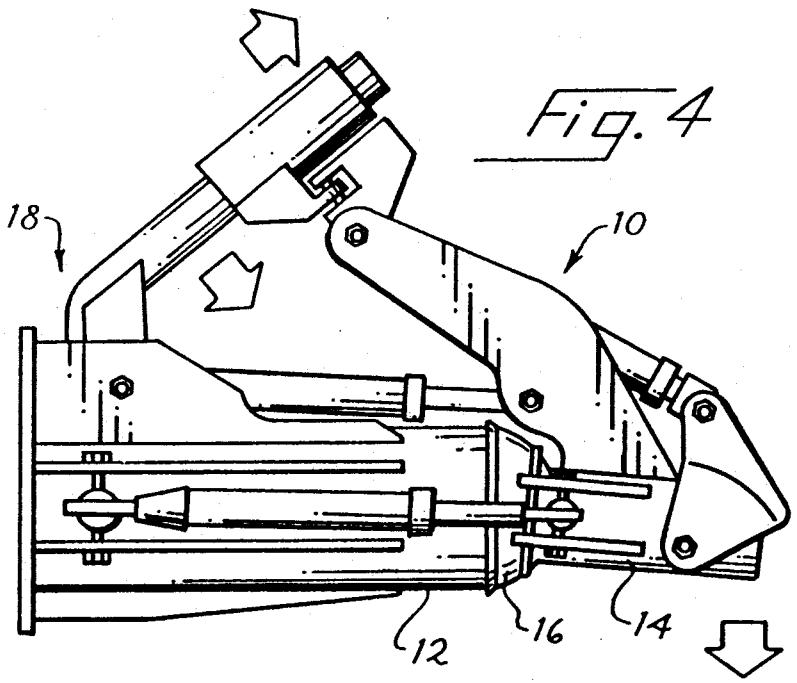
FIG. 4 is a side view corresponding to FIG. 2 showing the stern drive system of FIG. 1 with the jet nozzle pointed downwardly.

Because the rod 64 is prevented from moving out of the vertical plane, and because of the construction of the pivot joint 78, complex steering motions are allowed, and yet the second propulsion element 14 is prevented from rotating about the Z axis. FIGS. 4-5 illustrate the position of the various components of the antirotation brace 60 when the second propulsion element 14 is steered to the port side (FIG. 5) and when the second propulsion element 14 is trimmed downwardly (FIG. 4).

As pointed out above, this invention is not limited to use with jet drives, and if desired the second propulsion element 14 can comprise a propeller as shown in FIG. 6. Furthermore, many changes and modifications can be made to the preferred embodiments described above, depending upon the particular application. For example, the pivot joint 78 can be implemented with a ball joint, and the telescoping action between the rod 64 and the sleeve 70 can be implemented with other structures. For example, multiple rods can be used instead of one, and if desired the rod can be mounted to move with the second propulsion element 14 and the sleeve can be mounted on the bracket 18. Of course, materials can range widely, depending upon the application. For many applications welded stainless steel plate or aluminum plate will be satisfactory, and bearing materials such as Delrin (TM) may be used in the sleeve 70.

Also it should be understood that it is not critical for all embodiments of this invention that the rod 64 be positioned in a vertical plane. If desired, the rod 64 can be positioned in other planes, either in alignment with one of the actuating cylinders or not.

It is therefore intended that the foregoing detailed description be regarded as illustrative rather than limiting, and that it be understood that it is the following claims, including all equivalents, which are intended to define the scope of this invention.

I claim:

1. In a stern drive system comprising: first and second propulsion elements; a bracket configured to support the first propulsion element outside a hull of a water vessel; a pivot joint interconnecting the first and second propulsion elements; and at least one actuator coupled to the second propulsion element to steer the second propulsion element; the improvement comprising:

an anti-rotation brace comprising a first portion and a second portion;

said first portion secured in place relative to said first propulsion element to resist rotation about a first axis defined by the first propulsion element;

said second portion secured to said second propulsion element to resist rotation of said second propulsion element about said first axis;

said first and second portions slidably interconnected to telescope together;

said first and second portions effective to brace the second propulsion element against rotation relative to the first propulsion element about said first axis, while accommodating steering of the second propulsion element by the actuator.

2. The invention of claim 1 wherein the second propulsion element comprises a nozzle.

3. The invention of claim 1 wherein the second propulsion element comprises a propeller.

4. The invention of claim 1 wherein said at least one actuator comprises:

a first actuator coupled to the second propulsion element to steer the second propulsion element in a steering plane; and a second actuator coupled to the second propulsion element to steer the second propulsion element in a trim plane oriented transverse to the steering plane.

5. The invention of claim 4 wherein the at least one actuator comprises only one actuator for each of the steering and trim planes.

6. The invention of claim 1 wherein the second portion is pivotably secured to the second propulsion element by a second pivot joint having two rotational degrees of freedom.

7. The invention of claim 1 wherein the actuator and the first portion are secured to the bracket such that the bracket, the first and second propulsion elements, the actuator and the anti-rotation brace form a modular unit.

8. The invention of claim 1 wherein the first portion is pivotably secured in place to pivot in a plane that includes the first axis.

9. The invention of claim 1 wherein said anti-rotation brace is unpowered, and wherein said first and second portions are slidably interconnected to telescope freely along the second axis.

10. In a stern drive system comprising: first and second propulsion elements; a bracket configured to support the first propulsion element outside a hull of a water vessel; a pivot joint interconnecting the first and second propulsion elements; and at least one actuator coupled to the second propulsion element to steer the second propulsion element; the improvement comprising:

an anti-rotation brace comprising a first portion and a second portion;

said first portion comprising a rod mounted to pivot with respect to the bracket in a first plane that passes through a first axis defined by the first propulsion element; said rod mounted to resist movement out of said first plane;

said second portion comprising a sleeve mounted to slide on the rod, and a second pivot joint interconnected between said sleeve and said second propulsion element to accommodate steering of the second propulsion element while resisting rotation of the second propulsion element about the first axis;

said first and second portions effective to brace the second propulsion element against rotation relative to the first propulsion element about said first axis, while accommodating steering of the second propulsion element by the actuator.

11. The invention of claim 10 wherein said at least one actuator comprises:

a first actuator coupled to the second propulsion element to steer the second propulsion element in a steering plane; and a second actuator coupled to the second propulsion element to steer the second propulsion element in a trim plane oriented transverse to the steering plane.

12. The invention of claim 11 wherein the at least one actuator comprises only one actuator for each of the steering and trim planes.

13. The invention of claim 10 wherein said second pivot joint defines two rotational degrees of freedom.

14. The invention of claim 10 wherein the actuator is secured to the bracket such that the bracket, the first and second propulsion elements, the actuator and the anti-rotation brace form a modular unit.

15. The invention of claim 10 wherein said anti-rotation brace is unpowered, and wherein said first and second portions are slidably interconnected to telescope freely along the second axis.

* * * * *